US005708388A

United States Patent [19]

Carlile

[11] Patent Number: 5,708,388

[45] Date of Patent: Jan. 13, 1998

[54] SINGLE CURRENT SOURCE CURRENT GENERATING CIRCIT FOR PERIODICALLY ACTIVATING AND DEACTIVATING PORTIONS OF AN IC

[75] Inventor: Paul Scot Carlile, Burlington, Vt.

[73] Assignee: International Business Machines Corporation, Armonk, N.Y.

[21] Appl. No.: 669,016

[22] Filed: Jun. 24, 1996

Related U.S. Application Data

[63] Continuation of Ser. No. 356,815, Dec. 15, 1994, abandoned.

[51] Int. Cl.[6] ..... G05F 1/10

[52] U.S. Cl. ..... 327/544; 327/404; 327/545

[58] Field of Search ..... 327/103, 108, 327/403, 404, 415, 416, 374, 544, 361, 408, 545, 546, 538, 540, 541, 543; 364/273.3, 273.5; 395/750; 307/64, 66

[56] References Cited

U.S. PATENT DOCUMENTS

| | | | |
|---|---|---|---|
| 4,808,848 | 2/1989 | Miller | 307/355 |
| 5,120,991 | 6/1992 | Takahashi | 327/108 |
| 5,140,183 | 8/1992 | Takenaka | 327/545 |
| 5,149,994 | 9/1992 | Neu | 327/538 |
| 5,162,666 | 11/1992 | Tran | 327/408 |
| 5,339,078 | 8/1994 | Vernon | 327/374 |
| 5,420,528 | 5/1995 | Shigehara | 327/544 |
| 5,488,321 | 1/1996 | Johnson | 327/66 |
| 5,497,117 | 3/1996 | Nakajima et al. | 327/404 |

*Primary Examiner*—Timothy P. Callahan
*Assistant Examiner*—Jung Ho Kim
*Attorney, Agent, or Firm*—Eugene I. Shkurko

[57] ABSTRACT

A semiconductor chip incorporating a current generating circuit that will both power-down selected circuitry during inactive or standby periods and yet maintain a bias current to other parts of the chip. More specifically, the current generating circuit has output lines for providing output currents that mirror the current source during chip power-on operation periods. During chip power-down operation periods, the current generating circuit uses a current bias generator to supply current only to circuits needing to be operational during a partial chip operational mode.

11 Claims, 2 Drawing Sheets

SINGLE CURRENT SOURCE CURRENT GENERATING CIRCIT FOR PERIODICALLY ACTIVATING AND DEACTIVATING PORTIONS OF AN IC

This application is a continuation of application Ser. No. 08/356,815 filed on Dec. 15, 1994, abandoned.

FIELD OF THE INVENTION

The present invention relates to integrated circuits, and more particularly to a current generating circuit that uses a single current source to control when current is to be supplied to selected circuits.

BACKGROUND OF THE INVENTION

Some integrated circuits (ICs) require a constant current bias to operate. There are disadvantages of needing a constant current bias. For example, with the popular use of battery operated laptop computers, there is a constant power drain on the batteries. These batteries typically already require constant recharging or replacing. A key consumer feature for laptops is to have longer battery life. Thus, chip designers have learned that by turning off the power to selected chips that are not required for the operation being performed, crucial power savings are gained. This turning off of power, also known as a power-down, will increase the battery life and the time between recharging and/or replacement.

However, there are certain associated disadvantages in using some complete chip power-down methods. First, for example, when whole chips are turned off, it takes precious operation time to turn the chips back on again, this time is also known as the chip power-up period. In the past, the speed requirements for chips were low enough so that the power-up periods were not of concern. However, to meet the ever developing faster computer speed requirements, this complete chip power-down method is no longer an option. One solution to increasing a chip's power-up speed is to use a bandgap voltage reference including a process and temperature insensitive start-up circuit and power-down capability circuit, which is shown in U.S. Pat. No. 4,857,823. The circuit, shown therein, includes a differential amplifier in a bandgap voltage reference stage that controls the source of current to contrasted bipolar devices in parallel paths. A comparator monitors the activities of the current source drive signal and compares that to an internally generated reference, which reference is configured to the matched in temperature and process variable effect the corresponding bandgap reference bipolar device and the current source device. During the circuit's start-up, a comparator initiates an injection of current into one bipolar device of a bandgap reference circuit to drive a bandgap loop into an appropriate one of two potential operating states. In summary, this circuit design boosts the start-up operations to gain start-up speed.

A second problem with turning off the whole chip is that there are often certain chips that can never be turned off during a product's operational periods. However, these key chips are not always using all their circuitry; only portions of the key chip's circuitry are typically being used at any given time. As a result, the unused circuits are needlessly consuming the limited battery resource.

Therefore, there is a need for circuitry that can selectively turn off unused circuits and/or to selectively decrease the power usage of selected circuits in integrated circuits during power-down periods to both shorten a chip's overall start-up period and save power.

The above described problems, and other problems, are solved through the subject invention that will become more apparent, to one skilled in the art, from the figures, detailed description of the subject invention, and appended claims.

SUMMARY OF THE INVENTION

The present invention is a circuit that may be incorporated in an integrated circuit that can selectively turn off unused circuits and/or selectively decrease the power usage of selected circuits in integrated circuits during power-down periods to both shorten a chip's overall start-up period and save power.

Specifically, one feature of the invention is to provide a single current source current generating circuit for periodically activating and deactivating portions of the chip. Specifically, the current generating circuit provides for portions of the chip's circuitry to be powered-down during inactive or standby periods while maintaining a bias current to those parts of the chip that need to be operating. The semiconductor chip includes at least two circuits for processing received signals. In addition, the chip has a single current supplied current generating circuit, which provides current to the two circuits during regular operational periods, yet will only provide current to one circuit during standby periods.

Another feature of the invention is that the current generating circuit can have at least two output lines for providing at least two output currents that are both mirrors of the single current source during power-on operation periods. During chip power-down operation periods, the single current supply is diverted or shut off, and the current generating circuit uses a current bias generator to supply a bias current to only circuits coupled to the second set of output lines. Bias current is removed from the other circuits coupled to the first set of output lines during power-down periods.

Still a further feature of the invention is that the current generating circuit can have at least one output line for providing a first current magnitude to a selected circuit, and during a chip power-down period provide a current of a different magnitude to the selected circuit.

Figure 1:
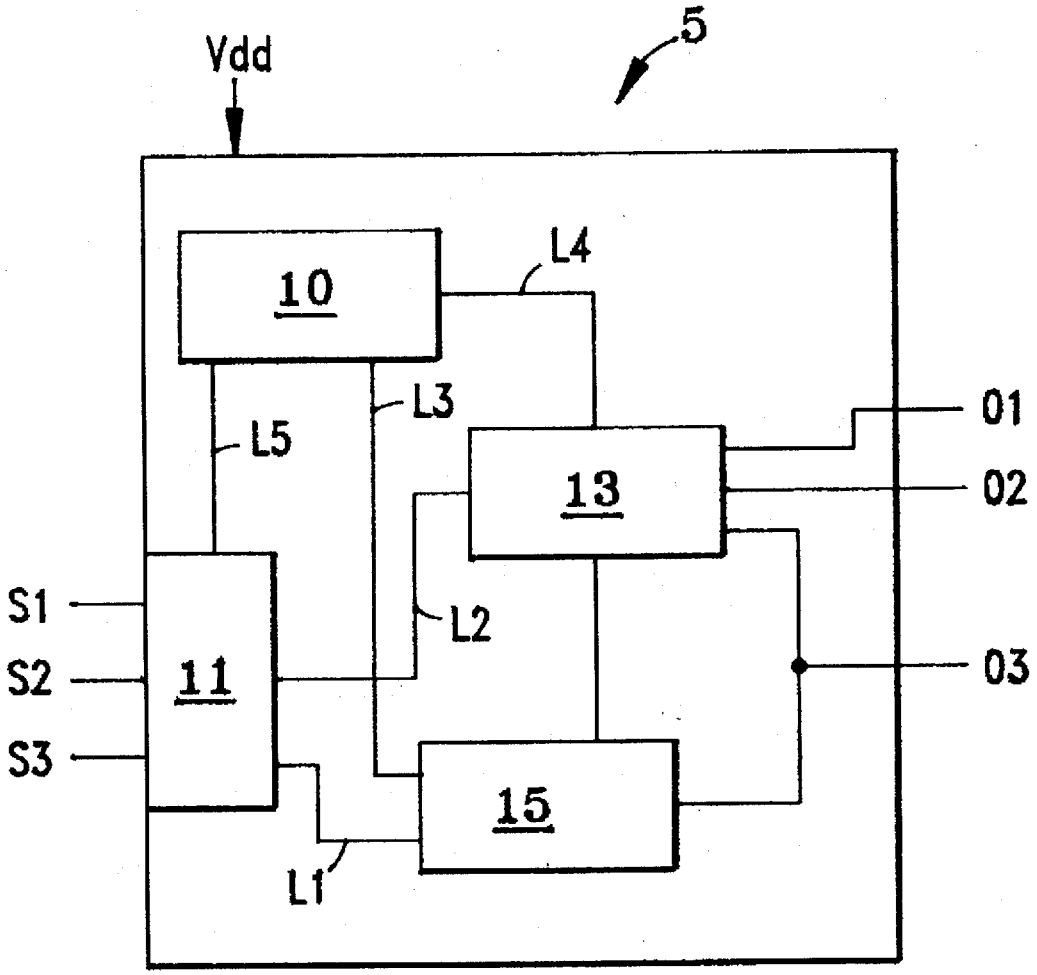
FIG. 1 is a block diagram of an integrated circuit illustrating one embodiment of the present invention.

It is noted that the drawings of the invention are not to scale. The drawings are merely schematic representations, not intended to portray specific parameters of the invention. The drawings are intended to depict only typical embodiments of the invention, and are therefore not to be considered limiting of its scope. Additionally, like numbering in the drawings represent like elements within and between drawings.

INCORPORATION BY REFERENCE

The following listed patents are herein incorporated by reference for pertinent and supporting information:

U.S. Pat. No. 4,857,823, is a bandgap voltage reference including a process and temperature insensitive start-up circuit and power-down capability. U.S. Pat. No. 5,281,866 is a reference voltage circuit allowing fast power-up from low power standby conditions.

DETAILED DESCRIPTION OF THE INVENTION

FIG. 1 is a block diagram of an integrated circuit chip including the current supply generator of the invention.

Integrated circuit (IC) 5 receives power from an off chip voltage source Vdd. Input signals S1, S2, and S3 are received by buffer circuit 11 coupled to lines L1 and L2. There are output lines 01, 02, and 03 for outputting the resultant chip signals. Circuits 13 and 15 receive signals from buffer circuit 11 via lines L1 and L2 and can do any number and kind of processing for the IC based on the input signals from buffer circuit 11. Current generating circuit 10 provides a current to circuits 11, 13, and 15 via lines L3, L4, and L5 during periods when the chip is in a full power-on period, requiring all of the chip circuits to be operational. During chip power-down periods, circuit 10 will provide, for example, a bias current to circuit 11 and 15, but not to circuit 13. Thus, the chip is saving power by not supplying current to circuit 13 during power-down periods. The present invention accomplished this by a unique design of circuit 10 discussed and illustrated hereinafter.

Figure 2:
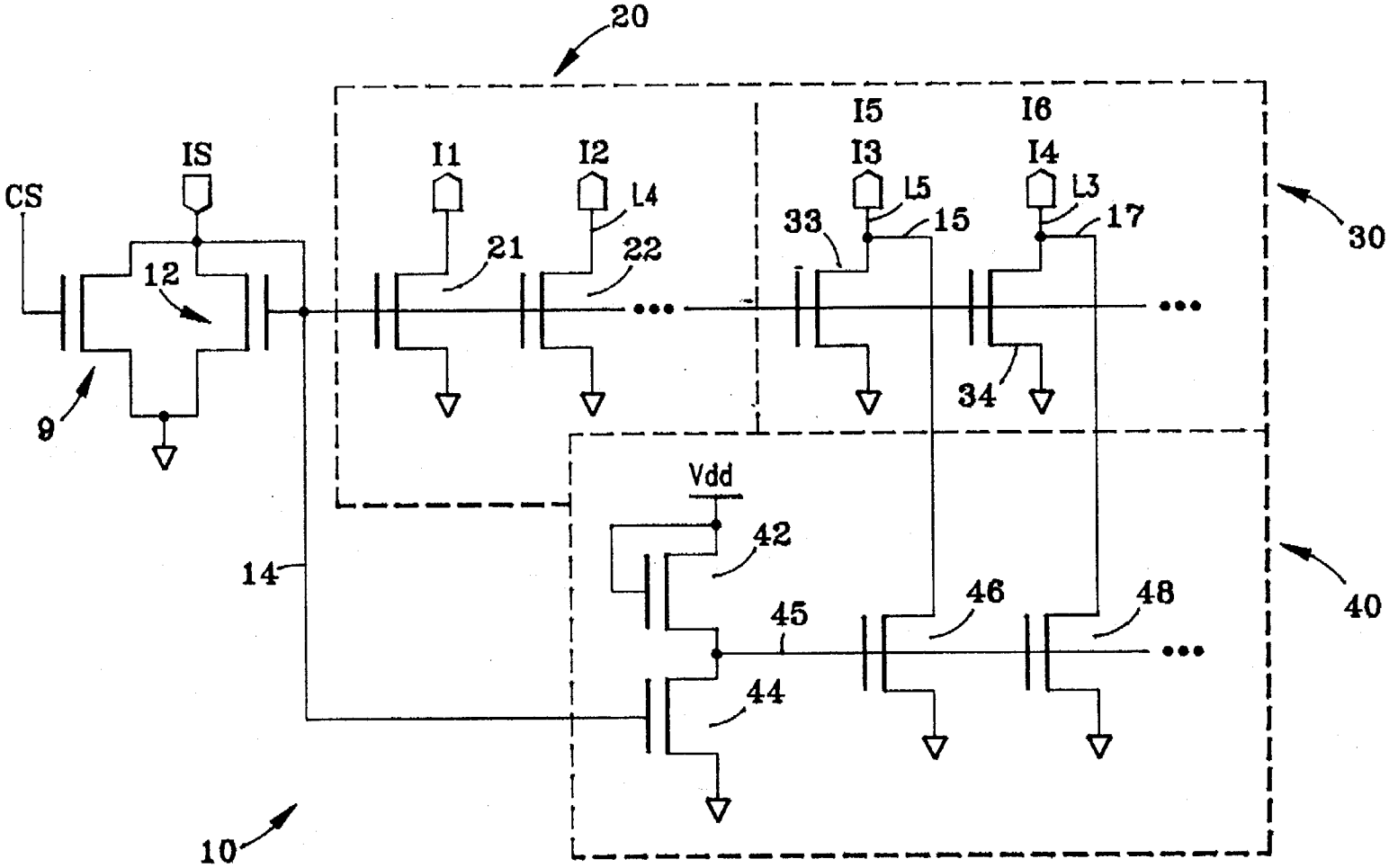
FIG. 2 is a detailed circuit diagram of the current generating circuit illustrated in FIG. 1.

FIG. 2 is a schematic diagram of circuit 10, having the following elements and operation: During a chip power-on period, a single current source, Is (for example, originating from an off-chip constant current source) is supplied to the current generating circuit 10. Control signal Cs keeps transistor 9 turned off, and thus diode 12 creates a high voltage on node 14 when the current passes therethrough. Current mirror circuits 20 and 30 produce currents that mirror Is. Specifically, transistors 21, 22, 33, and 34 are sized to have the same impedance of FET diode 12. Since they are all biased at their gates to the same voltage at node 14, they will conduct currents I1-4 respectively that match the magnitudes of Is. These generated currents have the advantage of being matched to the single current source, which is very difficult to do with a current generator circuit using several current sources. When current mirror circuits 20 and 30 are operating, bias current generating circuit 40 is deactivated. When node 14 is high, transistor 44 mirrors the current in transistor 12, which in turn pulls node 45 low, thus keeping switching transistors 46 and 48 off. Transistor 42 is sized to create enough resistance to pull node 45 down.

During a chip power-down period, the current source is shut off or diverted. For example, one of the many known ways to divert the current from circuit 10 is by coupling transistor 9 in parallel to transistor 12 and having a control signal Cs control the gate. Thus, when Cs goes low, the supply current will be drawn through transistor 9 to ground, diverting the current from circuit 10 and transistor 12. At this time, transistor 12 pulls node 14 low. In response, transistors 21, 22, 33, 34, and 44 are turned off preventing current from flowing therethrough. Simultaneously, node 45 is now able to be pulled high by the power supply Vdd through transistor 42, thereby turning on the gates of transistors 46 and 48. Transistors 46 and 48 are designed to operate in the triode region of the I-V curve so they act as simple resistor current sources when operating. Once transistors 46 and 48 are turned on, current I5 and I6 are equal to the voltages at node 15 and 17 divided by the resistance of transistors 46 and 48 respectively. Thus, currents are supplied to circuits (11 and 15) that need to be operational during the power-down, standby, or second period of chip operation.

It is noted that one use of the invention is to provide for faster general chip start-up operations. A circuit designer can connect key circuits, which slow the general chip power-up or processing time, to be receiving current during standby or power-down periods. Non-critical or faster power-up circuits can be powered down. Thus, when a chip is sent signals to process, the circuits that typically take longer to power-up or are the first circuits that need to be started (eg. input buffers) are already on.

One skilled in the art will appreciate that the operation of this invention guarantees that current will be continuously sustained, or non-interrupted, to those circuits (eg. 15) chosen to have current during power-down periods. There may be a slight dip in the current, but current will nonetheless be maintained.

One skilled in the art will also appreciate that the current generating circuit 10 can have at least one output line L5 for providing a first current magnitude I3 from circuit 30 to a selected circuit (eg. circuit 15), and during a chip power-down period provide a second smaller current I5 from the bias generating circuit 40 to the selected circuit.

There are a few invention variations that should be noted. For example, the bias currents through transistors 46 and 48 can have different magnitudes than the currents generated during the power-on periods. Having different current magnitudes would be particularly useful if a certain circuit does not have to be completely powered-up to meet increased speed requirements for the chip; for example, partial ramping-up of the circuit would be acceptable. Additionally, transistors 42 and 44 could be replaced by a control signal that is responsive to the single current source. The control signal would activate transistors 46 and 48 during power-down periods and turn them off during chip power-on periods. Another variation of the invention is that the currents in mirror circuits 20 and 30 do not need to be the same magnitudes. Some circuits may operate on less current, thus saving total power usage during a standby mode. Yet another variation of the invention, is to use two of these current generator circuits 10. A first generator, for example, would supply current to one part of the chip while it is in use (eg. 11 and 13), and the second generator would supply another part of the chip (eg. circuits 11 and 15) with current during its distinct operational period. An example of this would be a chip designed for read and write operations, where the read operation usually does not occur when the write operation is done. Both the read and write circuitry require some distinct circuitry that are not being used by both operations. It is further noted that transistor 12 does not have to be completely shut off from the supply current, it really only needs to be brought low enough to turn on transistor 44.

While the invention has been taught with specific reference to these embodiments, someone skilled in the art will recognize that changes can be made in form and detail without departing from the spirit and the scope of the invention. It will also be understood that the invention is not limited to the particular embodiment described herein, but is capable of many rearrangements, modifications, and substitutions without departing from the scope of the invention. The scope of the invention is, therefore, indicated by the appended claims rather than by this description.

What is claimed is:

1. A current generator comprising:

input means for receiving a control current;

first output means comprising a current mirror of the input means for providing a first output current over a first output line when the control current is at a sufficient magnitude for activating the input means; and bias means, coupled to the input means and to the first output means for providing a second output current over the first output line when the control current is at an insufficient magnitude to activate the input means; and second output means comprising a current mirror of the input means for providing a third output current over a second output line when the control current is at the sufficient magnitude.

2. The current generator of claim 1, wherein the input means includes an input transistor having its source coupled to a ground and its gate coupled to the first output means, the second output means, and the bias means.

3. The current generator of claim 2, wherein the first output means includes an output transistor having its gate coupled to the input transistor, its source coupled to the ground, and its drain coupled to the first output line.

4. The current generator of claim 2, wherein the second output means includes an output transistor having its gate coupled to the input transistor, its source coupled to the ground, and its drain coupled to the second output line.

5. The current generator of claim 2, wherein the bias means includes:

a first bias transistor having its gate coupled to the input transistor, its source coupled to the ground, and its drain coupled to a first node;

a resistive element coupled between a power supply and the first node; and a second bias transistor, having its gate coupled to the first node, its source coupled to the ground, and its drain coupled to the first output line, for supplying the second output current to the first output line when the control current is at the insufficient magnitude.

6. An integrated circuit, comprising:

a) a first circuit for processing received signals for the integrated circuit;

b) a second circuit for processing received signals for the integrated circuit;

c) first current generating means, coupled to a current source, and to the first and second circuit through a first and second output line, respectively, for providing current to the first and second circuit when the first current generating means receives current from the current source having sufficient magnitude for activating the first current generating means; and e) second current generating means coupled directly to the current source for providing current only to the first circuit when the second current generating means receives a signal from the current source for activating the second current generating means.

7. The integrated circuit of claim 8, wherein the first current generating means includes an input transistor with its source coupled to ground, and its gate coupled to the second current generating means.

8. The integrated circuit of claim 7, wherein the first output line includes a first transistor having its gate coupled to the input transistor and its source coupled to the ground.

9. The integrated circuit of claim 8, wherein the second output line includes a second transistor having its gate coupled to the input transistor and its source coupled to the ground.

10. The integrated circuit of claim 7, wherein the second current generating means includes:

a first bias transistor having its gate coupled to the input transistor, its source coupled to the ground, and its drain coupled to a first node;

a resistive element coupled between a power supply and the first node; end a second bias transistor, having its gate coupled to the first node, its source coupled to the ground, and its drain coupled to the first output line, for supplying the current only to the first circuit when the second current generating means receives the signal from the current source.

11. An integrated circuit having a current generating circuit that comprises:

a) input means for receiving a reference current, wherein the input means includes an input transistor with a source coupled to a ground;

b) first and second output means, coupled to the input means as current mirrors, for generating first and second output currents, wherein the first output means includes a first transistor having a gate coupled to the input transistor and a source coupled to the ground and a drain coupled to a first output line, and the second output means includes a second transistor having a gate coupled to the input transistor and a source coupled to the ground and a drain coupled to a second output line; and c) bias means, coupled to the input means and the second output line, for generating a third output current when the input means is not receiving the reference current, wherein the bias means includes:

a first bias transistor having a gate coupled to the input transistor and a source coupled to the ground and a drain coupled to a first node;

a resistive element coupled between a power supply and the first node; and a second bias transistor, having a gate coupled to the first node, a source coupled to the ground and a drain coupled to the second output line, for supplying the third output current.

* * * * *